United States Patent [19]

Pullen

[11] 4,250,809

[45] Feb. 17, 1981

[54] PERFECTING OR MULTICOLOR OFFSET PRINTING PRESS

[75] Inventor: Donald A. Pullen, San Diego, Calif.

[73] Assignee: Publishers Equipment Corporation, Dallas, Tex.

[21] Appl. No.: 68,414

[22] Filed: Aug. 21, 1979

[51] Int. Cl.[3] ..... B41F 13/28; B41F 13/40; B41F 7/10

[52] U.S. Cl. ..... 101/177; 101/180; 101/182; 101/221

[58] Field of Search ..... 101/177, 178, 179, 180, 101/181, 182, 217, 218, 143, 144, 247, 145, 135, 136, 137, 138, 139, 140, 142, 183, 184, 185, 220, 221, 222, 223, 224, 225

[56] References Cited

U.S. PATENT DOCUMENTS

| | | | |
|---|---|---|---|
| 3,329,086 | 7/1967 | Pullen | 101/220 X |
| 3,983,811 | 10/1976 | Fuchs et al. | 101/180 X |

FOREIGN PATENT DOCUMENTS

| | | | |
|---|---|---|---|
| 2725030 | 12/1978 | Fed. Rep. of Germany | 101/247 |

*Primary Examiner*—J. Reed Fisher
*Attorney, Agent, or Firm*—W. Thomas Timmons

[57] ABSTRACT

A web fed offset printing press unit (42) including a frame (12), an auxiliary frame (44), a pair of plate cylinders (46 and 46*a*), a first blanket cylinder (48), a second blanket cylinder (50), a common impression cylinder (56) and an auxiliary impression cylinder (58) is disclosed. The second blanket cylinder is swung bodily through a short radius arc between a first end position in rolling contact with the common impression cylinder and a second end position in rolling contact with the auxiliary impression cylinder.

In one arrangement, the second blanket cylinder is journaled in an eccentric sleeve (76) at each end and linkage (86) is switchable between the two modes of operation with a throw-off position associated with each.

A method for converting a web fed letterpress unit (10) into a web fed offset printing press unit for multicolor or two-sided printing is disclosed.

3 Claims, 6 Drawing Figures

PERFECTING OR MULTICOLOR OFFSET PRINTING PRESS

DESCRIPTION

TECHNICAL FIELD

The present invention relates generally to printing presses, and in one of its aspects, to a method and apparatus for converting a web fed letterpress unit into a web fed offset printing press unit which is convertible between perfecting and multicolor.

The news publishing industry has billions of dollars worth or letterpress equipment in the United States. The newspaper industry has, however, been switching from letterpress to offset printing for numerous reasons including improved quality of print and lowered operating cost. At present, publishers have had little option other than to purchase new offset equipment to replace their letterpress equipment.

BACKGROUND ART

A method has now been developed for conversion of letterpress units to offset printing units by removing the letterpress cylinders, placing an auxiliary frame for supporting offset printing cylinders inside the main frame, and then installing the offset printing cylinders inside the auxiliary frame.

A perfecting or multicolor offset printing press invented by the present inventor is disclosed in U.S Pat. No. 3,329,086. That patent shows the combination of a frame, a pair of plate cylinders laterally spaced in the frame for mounting printing plates thereon with a pair of blanket cylinders in rolling contact with their respective plate cylinders and an impression cylinder centered with respect to the cusp formed by the blanket cylinders. The blanket cylinders can be moved through a short radius arc between a first position in which the blanket cylinders make contact with their respective plate cylinders and with each other for blanket-to-blanket printing and a second position in which in the blanket cylinders make contact with their respective plate cylinders and with the impression cylinder for blanket-to-impression printing. The first position can be used for black printing on both sides of a web or single color perfecting when there is a half deck for providing an additional blanket cylinder in rolling contact with the impression cylinder. The second position can be used for applying two colors to the same side of a web, or three colors if there is a half deck.

To convert a black letterpress unit to the perfecting or multicolor offset press shown in the inventor's prior patent by the conversion process described requires substantial reworking of the letterpress unit including installing an auxiliary frame which is capable or supporting at least both ends of both blanket cylinders and the impression cylinder. This is necessary because of the distances through which the blanket cylinders are swung to go between the different modes of operation. In addition, if a web breaks while it is in the cusp between the blanket cylinders and the impression cylinder, the resultant web jamb can be very difficult to clear.

DISCLOSURE OF INVENTION

In accordance with the present invention, a web fed offset printing press unit for multicolor and single color perfected printing includes a frame, a pair of plate cylinders laterally spaced in the frame for mounting printing plates thereon, means for applying films of ink to the plates, a first and a second blanket cylinder, spaced apart inclined toward one another with respect to the plate cylinders, a common impression cylinder substantially equal distances from the plate cylinders and an auxiliary impression cylinder located in near proximity to the second blanket cylinder such as between and spaced apart from the plate cylinders. The first blanket cylinder has a position for rolling contact with its plate cylinder and the common impression cylinder for applying an inked image to one side of a web fed between it and the common impression cylinder. The combination also includes a means for bodily swinging the second blanket cylinder through a short radius arc between a first position in rolling contact with its plate cylinder and the common impression cylinder for applying an inked image on the same side of a web as the first blanket cylinder when the web is fed about the common impression cylinder and a second position in rolling contact with its plate cylinder and the auxiliary impression cylinder for applying an inked image on the opposite side of a web as the first blanket cylinder when the web is fed between both blanket cylinder-impression cylinder pairs. Means is provided for driving these cylinders with a provision for reversing the direction of rotation of one of the blanket cylinders and its cooperating cylinders in the respective modes of operation.

In one arrangement, the means for bodily swinging the second blanket cylinder can also swing the second blanket cylinder into a first mid position in which it is displaced from its associated cylinders into a throw-off position from the first end position, and a second mid position in which it is displaced from its associated cylinders into a throw-off position from the second end position. The second blanket cylinder is journaled into an eccentric sleeve on each end. In such as arrangement, the means for bodily swinging the second blanket cylinder includes an adjustable stop for defining each end position for the sleeves as they are rocked to one end position or the other and operating linkage connecting the sleeves for rocking the sleeves simultaneously. The linkage is adjustable between a first mode for rocking the second blanket cylinder between the first end position and the first mid position and a second mode for rocking between the second end position and the second mid position.

The convertible offset press of this invention is especially well suited for a method for converting a web fed letterpress unit, such as a black unit, into a convertible offset unit. The method includes the steps of removing the letterpress plate and impression cylinders, installing a means for rotatably supporting an auxiliary impression cylinder between and spaced apart from the letterpress plate cylinders, installing the auxiliary impression cylinder in its support means, installing the offset plate and blanket cylinders either through the bores in the main frame for the letterpress cylinders or in an auxiliary frame, installing a means for rotatably supporting a common impression cylinder substantially above the blanket cylinders and equal distances from the plate cylinders, installing the common impression cylinder in its support means, and installing a means for bodily swinging one of the blanket cylinders through a short raduis arc between the two end positions. The means for rotatably supporting the impression cylinders can be the auxiliary frame for supporting any other cylinders plus the necessary bearings. A means for driving the cylinders with provision for reversing the direction of rotation of one of the blanket cylinders and its cooperating cylinders in the respective modes of operation is also installed.

These and other objects, advantages and features of this invention will be apparent from the following description taken with reference to the accompanying drawings, wherein is shown the preferred embodiments of the invention.

BEST MODE FOR CARRYING OUT THE INVENTION

Figure 1:
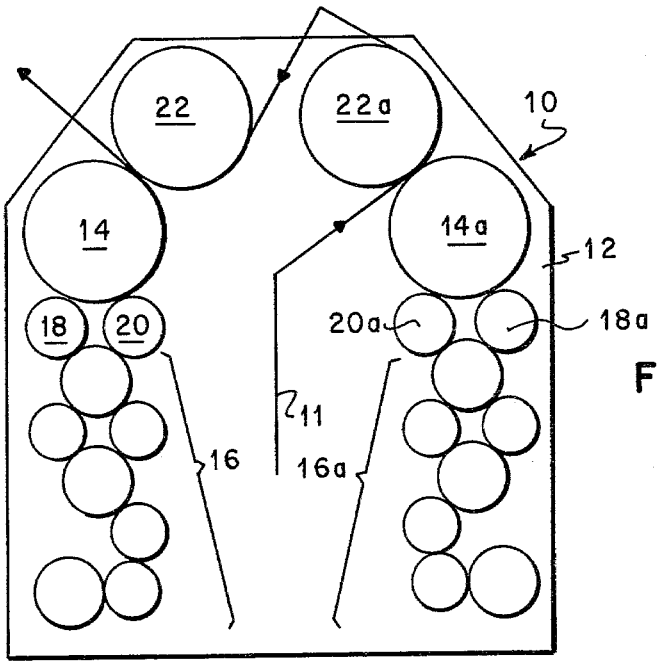
FIG. 1 is a diagramatic cross-sectional view taken from one end of a web fed letterpress unit.

Referring now to the drawing, and in particular to FIG. 1, a typical web fed letterpress unit, referred to generally by reference numeral 10 prints on both sides of a web 11. Letterpress unit 10 includes a main frame 12, a pair of plate cylinders 14 and 14*a* laterally spaced in frame 12 for mounting printing plates thereon, means including ink transfer rollers and cylinders or drums 16 and 16*a* and form rollers 18, 18*a*, 20 and 20*a* for applying films of ink to the plates. Letterpress unit 10 also includes a pair of impression cylinders 22 and 22*a* in respective rolling contact with the plates on the plate cylinder 14 and 14*a* respectively.

Figure 2:
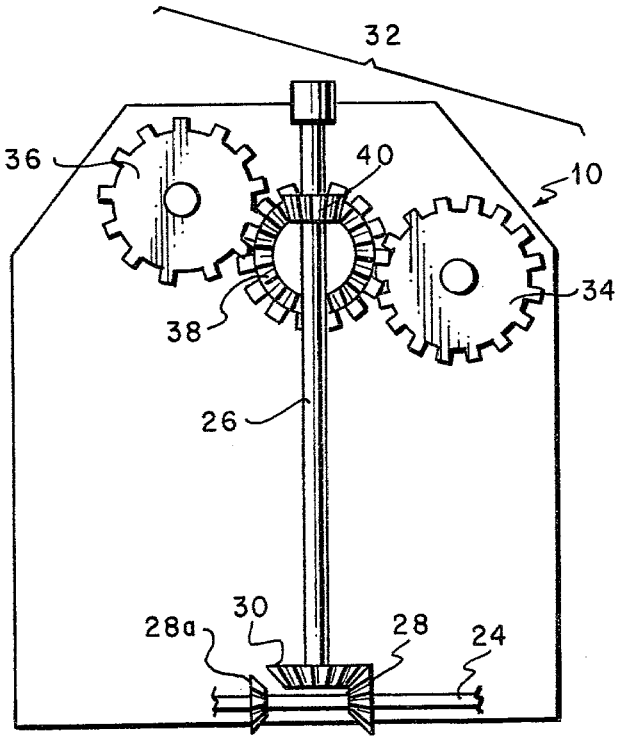
FIG. 2 is a diagramatic end view of the letterpress unit of FIG. 1.

Referring also to FIG. 2, the letterpress unit is driven by a horizontal shaft 24 which drives a vertical drive shaft 26 through beveled gears 28 and 30. Vertical drive shaft 26 in turn drives the letterpress cylinders through gear train 32 which includes a spur drive gear 34 for cylinder 14*a*, a spur drive gear 36 for impression cylinder 22 and a spur gear-bevel gear combination 38 driven by vertical shaft 26 through beveled gear 40. On the far end of frame 12 are mounted spur gears corresponding to each of the plate cylinders 14 and 14*a* and each of the impression cylinders 22 and 22*a* so that the gear for plate cylinder 14*a* drives the gear for impression cylinder 22*a*, and the gear for impression cylinder 22 drives the gear for plate cylinder 14.

Figure 3:
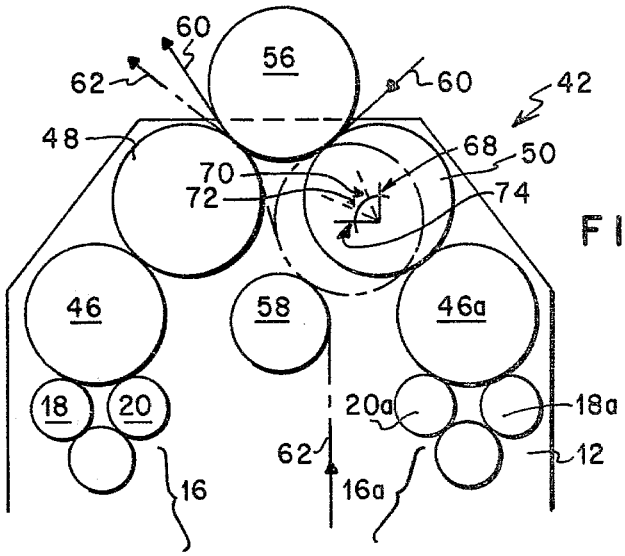
FIG. 3 is a diagramatic sectional view similar to that of FIG. 1 of the press of FIG. 1 after it has been converted into a web fed offset printing press unit according to the present invention.
Figure 4:
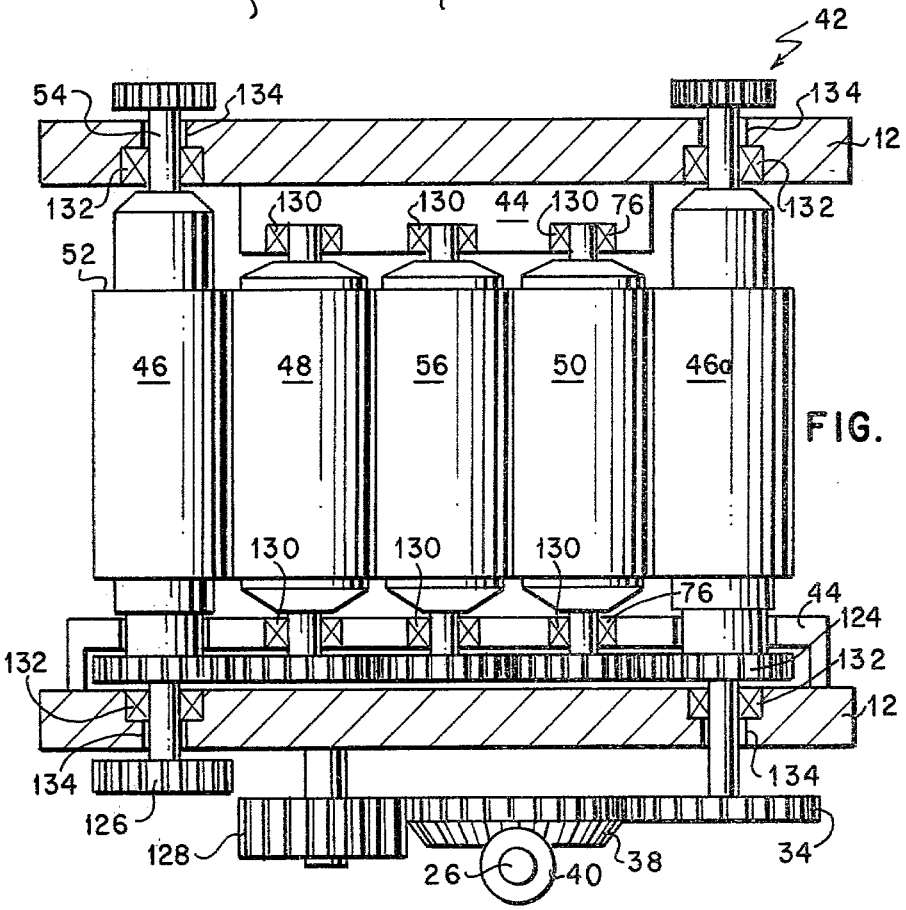
FIG. 4 is a top view of the offset printing press of FIG. 3 partly in section to show the bores in the press main frame.

Referring now to FIGS. 3 and 4, a web fed offset printing press unit converted from web fed letterpress unit 10 of FIGS. 1 and 2 is referred to generally by reference numeral 42. It includes main frame 12, ink transfer rollers and drums 16 and 16*a*, and form rollers 18, 18*a*, 20 and 20*a*. It also includes the same driving mechanism as the letterpress unit through vertical shaft 26, bevel gear 40, combination spur gear-bevel gear 38 and spur gear 34. Typically, the spur gears will be helical gears. Offset press unit 42, however, also has a means for rotatably supporting offset cylinders, in this cas auxiliary frame 44 inside main frame 12 for receiving cylinders. A pair of offset plate cylinders 46 and 46*a* are laterally spaced inside at least one frame for mounting printing plates thereon. A first blanket cylinder 48 and a second blanket cylinder 50 are spaced apart inside the frames and inclined toward one another with respect to the plate cylinders 46 and 46*a*. Considering each of the cylinders, for instance cylinder 46 to include both a drum 52 and a shaft 54, it can be seen that the shaft for some cylinders extends beyond auxiliary frame 44 and even beyond main frame 12. The cylinders are thus "inside the frames" in the sense that they are primarily inside the frames. A common impression cylinder 56 is substantially equal distances from plate cylinders 46 and 46*a* and an auxiliary impression cylinder 58 is located in near proximity to second blanket cylinder 50, which in this case is generally between and spaced apart from plate cylinders 46 and 46*a*. First blanket cylinder 48 has a position for rolling contact with its plate cylinder 46 and the common impression cylinder 56 for applying an inked image to one side of a web 60 or 62 fed between it and the common impression cylinder 56.

Figure 5:
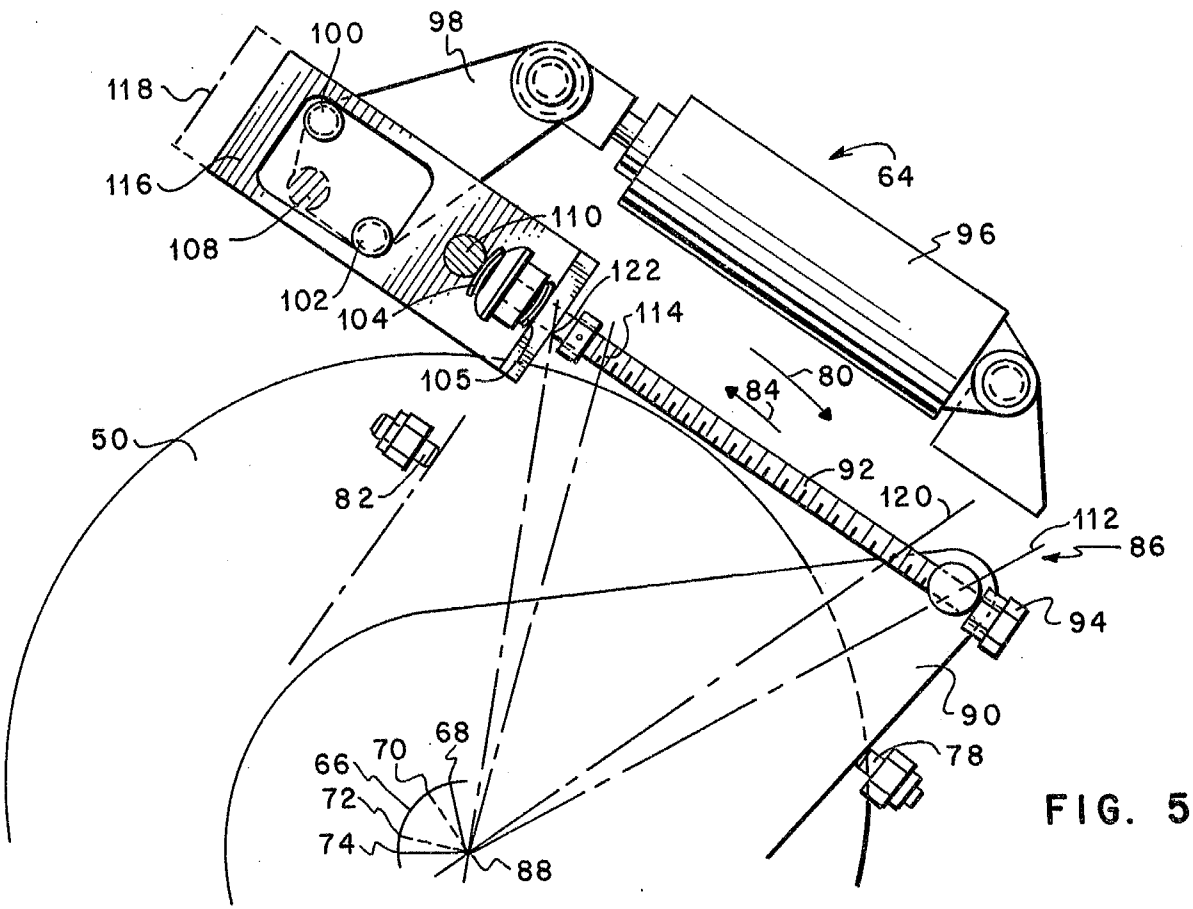
FIG. 5 is a fragmentary view of the linkage employed in positioning one of the blanket cylinders.

Referring also to FIG. 5, offset printing press unit 42 also includes a means 64 for bodily swinging second blanket cylinder 50 through a short radius arc represented by line 66 between a first end position in rolling contact with its plate cylinder 46*a* and common impression cylinder 56 for applying an inked image on the same side of web 60 as first blanket cylinder 48 when the web is fed about common impression cylinder 56, a second end position in rolling contact with its plate cylinder 46*a* and auxiliary impression cylinder 58 for applying an inked image on the opposite side of web 62 as first blanket cylinder 48 when the web is fed between both blanket cylinder-impression cylinder pairs, a first mid position in which it is displaced from its associated cylinders 46*a* and 56 into a throw-off position from the first end position, and a second end position in which it is displaced from its associated cylinders 46*a* and 58 into a throw-off position from the second end position. The blanket cylinder-impression cylinder pairs being the pair made up of first blanket cylinder 48 and common impression cylinder 56 and the pair made up of second blanket cylinder 50 and auxiliary impression cylinder 58. The center of second blanket cylinder 50 is located at point 68 in the first end position, 70 in the first mid position, 72 in the second mid position, and at 74 in the second end position.

Second blanket cylinder 50 is journaled in an eccentric sleeve 76 at each end, shown schematically as part of the bearings for second blanket cylinder 50. Means 64 for bodily swinging second blanket cylinder 50 includes an adjustable stop 78 for defining the first end position for sleeves 76 as they are rocked in one direction 80 which is shown as clockwise, an adjustable stop 82 for defining the second end position for sleeves 76 as they are rocked in a second direction 84 which is counterclockwise as illustrated and operating linkage 86 connected to the sleeves for rocking the sleeves simultaneously. Operating linkage 86 is adjustable between a first mode for rocking between the first end position and the first mid position and a second mode for rocking between the second end position and the second mid position. The center for the eccentric sleeves is referred to by reference numeral 88. Arm 90 which is part of linkage 86 is affixed to one sleeve 76, and a similar arm is affixed to the sleeve at the opposite end of second blanket cylinder 50. Linkage 86 is illustrated for only one end of second blanket cylinder 50 since the linkage for both ends will operate identically. The end of arm 90 which is remote from point 88 is connected to long screw 92 with its position along long screw 92 fixed by changeover adjustment 94. Linkage 86 includes an hydraulic or pneumatic cylinder 96 which moves second blanket cylinder 50 between an end position and the associated mid position through the rest of linkage 86. Hydraulic cylinder 96 moves long screw 92 by arm 98 and cam followers 100 and 102. Belleville springs 104 and 106 are quite stiff, requiring about 3,000 pounds of pressure to yield in the neighborhood of 0.005 of one inch, but give some shock absorbing capability to linkage 86. Cross shaft 108 couples any change of position of cam followers 100 and 102 to the linkage at the other end of blanket cylinder 50, and cross shaft 110 helps by coupling the movement of long screw 102 to the corresponding linkage on the other end of second blanket cylinder 50.

It can thus be seen that changeover adjustment 94 is used to change arm 90 from the first mode to the second mode. For the retracted position of hydraulic cylinder 96, changeover adjustment 94 is positioned so that arm 90 is in position 112 for the first mode and end position 114 for the second mode corresponding to the first end position and the second mid positions respectively. When hyraulic cylinder 96 is extended so that cam housing 116 is in position 118, changeover adjustment 94 holds arm 90 in position 120 for the first mode and position 122 for the second mode corresponding to the first mid position and the second end position respectively. The first end position 112 of arm 90 can be adjusted by adjusting adjustable stop 78, and the second end position 122 of arm 90 can be adjusted by adjusting adjustable stop 82.

Preferably first blanket cylinder 48 is equipped with a throw-off mechanism such as is well known in the art.

Referring again to FIG. 4, offset press unit 42 also includes means for driving the cylinders including gear train 124, gear 126 associated with plate cylinder 46 and sliding gear 128. In the first end position, which is for multicolor printing, gear train 124 drives straight across with the gear for plate cylinder **46*a* driving the gear for second blanket cylinder 50 which drives the gear for common impression cylinder 56 which drives the gear for first blanket cylinder 48 which drives the gear for plate cylinder 46. In the first end position, sliding gear 128 idles only. In the second end position, which is for printing on both sides of a web and can be used for single colored perfecting as will be seen, the gear for second blanket cylinder 50 is taken completely out of contact with the gear for common impression cylinder 56. Sliding gear 128 is slid toward frame 12 so that it engages both spur gear-bevel gear combination 38 and gear 126 associated with plate cylinder 46. In order for the web to move smoothly between both blanket cylinder-impression cylinder pairs, the gear ratios must be set so that both blanket cylinders turn at the same speed. Shaft 24 is slid so that bevel gear 28 is out of mesh and a bevel gear 28*a* which faces the opposite direction on shaft 24 is in mesh with bevel gear 30, thus reversing the direction of rotation of vertical shaft 26. In the second end position, the gear for plate cylinder 46*a* drives the gear for second blanket cylinder 50 which in turn drives the gear for auxiliary impression cylinder 58. Sliding gear 128 drives gear 126 which is affixed to shaft 54 of plate cylinder 46. The gear of gear train 124 for plate cylinder 46 drives the gear for first blanket cylinder 48 which in turn drives the gear for common impression cylinder 56. Thus the means for driving the cylinders includes a provision for reversing the direction of one of the blanket cylinders, in this case second blanket cylinder 50**, and its cooperating cylinders in the respective modes of operation.

It can now be seen that method for converting web fed letterpress unit 10 into web fed offset printing press unit 42 includes in combination the steps of removing the pair of letterpress plate cylinders 14 and **14*a* and the pair of letterpress impression cylinders 22 and 22*a*, installing inside the main frame a means for rotatably supporting offset cylinders, in this case auxiliary frame 44 which can be used to support all or only some of the offset cylinders, installing a pair of offset plate cylinders, installing a pair of blanket cylinders for respective rolling contact with the offset plate cylinders, installing common impression cylinder 56 and installing a means for bodily swinging one of the blanket cylinders, in this case second blanket cylinder 50, through a short radius arc between a first position in rolling contact with its plate cylinder and the common impression cylinder and a second position in rolling contact with its plate cylinder and the auxiliary impression cylinder. Preferably, the means also includes means for swinging the second blanket cylinder to the mid positions. Also included is the step of installing means for driving the cylinders with provision for reversing the direction of rotation of one of the blanket cylinders and its cooperating cylinders in the respective modes of operation. In one arrangement, the means for rotatably supporting offset cylinders includes a means for rotatably supporting auxiliary impression cylinder 58 between and spaced apart from plate cylinders 46 and 46*a* and means for rotatably supporting common impression cylinder 56 substantially above blanket cylinders 48 and 50 and substantially equal distances from plate cylinders 46 and 46*a*. The blanket cylinders and impression cylinders are rotatably supported in auxiliary frame 44 by bearings 130. One major advantage of the conversion is that for many units, it will be possible to extend the shafts of the plate cylinders and even the blanket cylinders through the bores in the main frame for the letterpress plate cylinders and letterpress impression cylinders respectively. In such an arrangement, the size and complexity of auxiliary frame 44 can be substantially reduced. It is not necessary to always make the common impression cylinder substantially equal distances from the two plate cylinders, but it should be a distance less than or equal to the diameter of a blanket cylinder from the respective plate cylinder so that both blanket cylinders can be in rolling contact with the common impression cylinder and their respective plate cylinders. In the arrangement illustrated, plate cylinder 46 and 46*a* are rotatably supported by main frame 12 by bearings 132 installed in the bores 134** for the letterpress plate cylinders.

Figure 6:
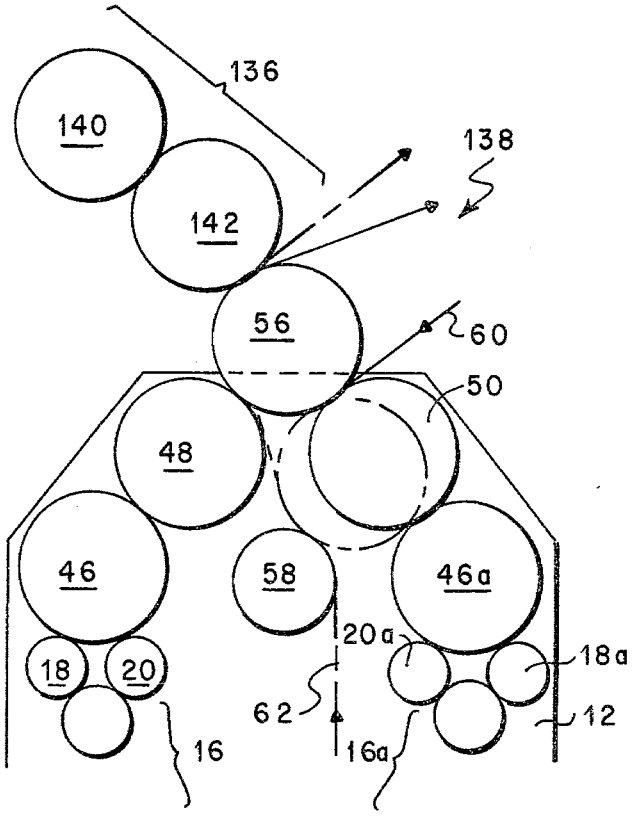
FIG. 6 is a diagramatic sectional view similar to that of FIG. 3 for an alternative embodiment of the present invention.

Referring now to FIG. 6, in converting from a letterpress unit which has a half deck 136, or by adding half deck 136, the present invention can be used for making an offset unit 138 which can be used for three color or single color perfected printing. An offset plate cylinder 140 and an offset blanket cylinder 142 are installed in place of the letterpress plate and impression cylinders respectively if the unit already had a half deck. It can easily be seen that webs 60 and 62 are simply wound further around impression cylnder 56 between common impression cylinder 56 and half deck blanket cylinder 142 to add another color.

It is important to note that auxiliary impression cylinder 58 does not have to be the same size as the blanket cylinders since the web which is fed from underneath, web 162, is always a clean web so that there is no smearing on the side of the web next to auxiliary impression cylinder 58.

Since first and second blanket cylinders 48 and 50 never print blanket to blanket in the present invention, the problem of troublesome paper jams in the cusp of three cylinders is avoided. Furthermore, the present invention allows the maximum use of the existing main frames in conversions from black units to multicolor convertible units.

From the foregoing it will be seen that this invention is one well adapted to attain all of the ends and objects hereinabove set forth, together with other advantages which are obvious and which are inherent to the apparatus. It will be understood that certain features and subcombinations are of utility and may be employed without reference to other features and subcombinations. This is contemplated by and is within the scope of the claims.

As many as possible embodiments may be made of the invention without departing from the scope thereof, it is to be understood that all matter herein set forth or shown in the accompanying drawings is to be interpreted as illustrative and not in a limiting sense. 9n

I claim:

1. In a web offset printing press unit, the combination comprising:

a frame;

a pair of plate cylinders laterally spaced in the frame for mounting printing plates thereon;

means for applying films of ink to the plates;

a first and a second blank cylinder; spaced apart, inclined toward one another with respect to the plate cylinders;

a common impression cylinder substantially equal distances from the plate cylinders wherein the first blanket cylinder has a position for rolling contact with its plate cylinder and the common impression cylinder for applying an inked image to one side of a web fed between it and the common impression cylinder;

an auxiliary impression cylinder located in near proximity to the second blanket cylinder;

a means for bodily swinging the second blanket cylinder through a short radius arc between a first position in rolling contact with its plate cylinder and the common impression cylinder for applying an inked image on the same side of a web as the first blanket cylinder when the web is fed about the common impression cylinder and a second position in rolling contact with its plate cylinder and the auxiliary impression cylinder for applying an inked image on the opposite side of a web as the first blanket cylinder when the web is fed between both blanket cylinder-impression cylinder pairs; and means for driving the cylinders with provision for reversing the direction of rotation of one of the blanket cylinders and its cooperating cylinders in the respective modes of operation.

2. In a web fed offset printing press unit, the combination comprising:

a frame;

a pair of plate cylinders laterally spaced in the frame for mounting printing plates thereon;

means for applying films of ink to the plates;

a first and a second blanket cylinder, spaced apart, substantially above and to the inside of the plate cylinders;

a common impression cylinder substantially above the blanket cylinders and substantially equal distances from the plate cylinders wherein the first blanket cylinder has a position for rolling contact with its plate cylinder and the common impression cylinder for applying an inked image to one side of a web fed between it and the common impression cylinder;

an auxiliary cylinder between and spaced aprat from the plate cylinders;

a means for bodily swinging the second blanket cylinder through a short radius arc between a first end position in rolling contact with its plate cylinder and the common impression cylinder for applying an inked image on the same side of a web as the first blanket cylinder when the web is fed about the common impression cylinder, a second end position in rolling contact with its plate cylinder and the auxiliary impression cylinder for applying an inked image on the opposite side of a web as the first blanket cylinder when the web is fed between both blanket cylinder-impression cylinder pairs, a first mid position in which it is displaced from its associated cylinders into a throw-off position from the first end position; and a second mid position in which it is displaced from its associated cylinders into a throw-off position from the second end position; and means for driving the cylinders with provision for reversing the direction of rotation of one of the blanket cylinders and its cooperating cylinders in the respective modes of operation.

3. The combination according to claim 2 further comprising a pair of eccentric sleeves wherein the second blanket cylinder is journaled in a sleeve at each end, and the means for bodily swinging the second blanket cylinder comprises in combination:

an adjustable stop for defining the first end position for the sleeves as they are rocked in one direction;

an adjustable stop for defining the second end position for the sleeves as they are rocked in a second direction; and operating linkage conected to the sleeves for rocking the sleeves simultaneously, the linkage being adjustable between a first mode for rocking between the first end position and the first mid position and a second mode for rocking between the second end position and the second mid position.

* * * * *

UNITED STATES PATENT AND TRADEMARK OFFICE

CERTIFICATE OF CORRECTION

PATENT NO. : 4,250,809

DATED : February 17, 1981

INVENTOR(S) : Donald A. Pullen

It is certified that error appears in the above-identified patent and that said Letters Patent are hereby corrected as shown below:

Column 1, line 54, "or" should be ---of---.

Column 3, line 68, "cas" should be ---case---.

Column 6, line 6, after "that" insert ---a---.

Column 7, line 23, delete [as] (Second occurence).

Column 7, line 35, "blank" should be ---blanket---.

Column 7, line 35 ";" should be ---,---.

Column 8, line 20, "aprat" should be ---apart---.

Signed and Sealed this

*Twelfth* Day of *May 1981*

[SEAL]

*Attest:*

RENE D. TEGTMEYER

*Attesting Officer* *Acting Commissioner of Patents and Trademarks*